United States Patent [19]

Kellett

[11] Patent Number: 4,469,181

[45] Date of Patent: Sep. 4, 1984

[54] ADJUSTABLE CONDUCTOR GUIDE ASSEMBLY FOR SUB-SEA WELLS AND METHODS AND TOOLS FOR ADJUSTMENT THEREOF

[75] Inventor: Rodney Kellett, Leeds, England

[73] Assignee: Cameron Iron Works, Inc., Houston, Tex.

[21] Appl. No.: 469,086

[22] Filed: Feb. 23, 1983

[30] Foreign Application Priority Data

Feb. 24, 1982 [GB] United Kingdom ..... 8205409

[51] Int. Cl.[3] ..... E21B 43/01

[52] U.S. Cl. ..... 166/341; 405/195

[58] Field of Search ..... 166/341-343, 166/241, 237, 362, 368; 175/7, 85, 220; 405/195, 227; 33/180 R, 286, DIG. 8; 242/157 R

[56] References Cited

U.S. PATENT DOCUMENTS 4,344,721 8/1982 Goldsmith ..... 405/195 X

*Primary Examiner*—Ernest R. Purser
*Assistant Examiner*—Thuy M. Bui
*Attorney, Agent, or Firm*—Vinson & Elkins

[57] ABSTRACT

An adjustable conductor guide assembly for a sub-sea well which includes an outer ring supported on an inner guide with the axes of the ring and guide being laterally offset so that rotation of the outer ring on its support changes the position of the axis of inner guide. The improved method of aligning a conductor guide with a sub-sea well head includes the steps of supporting the conductor guide assembly on a platform installed over the well head, lowering a tool through the guide and rotating the conductor guide assembly to align the axis of the guide as close as possible with the well head, locking the conductor guide assembly in its set position and retrieving the tool. The improved tool includes a body fo passing through the guide, means for engaging the conductor guide assembly to lift and rotate such assembly, means for limiting the amount of angular movement during rotation and a string on which the body is mounted.

11 Claims, 8 Drawing Figures

7
8
10
1
61
50
44
66
8
31
52
42
7
10
60
32
51
45
46
39
60
18
66
2
17

A1
P1
71
T
A2
P2
38
72
W
T'

ADJUSTABLE CONDUCTOR GUIDE ASSEMBLY FOR SUB-SEA WELLS AND METHODS AND TOOLS FOR ADJUSTMENT THEREOF

BACKGROUND

This invention relates to sub-sea wells and more particularly to adjustable conductor guides and methods and tools for adjustment thereof.

Early offshore production can be achieved by means of the template tieback system, wherein development drilling and platform construction can run concurrently. Development wells are pre-drilled through a sub-sea template from a floating rig and the wells tied back to the production platform following its installation over the template. The major advantage of the tieback concept is that return on investment can be quicker than for wells drilled conventionally from a fixed platform.

There is a risk of misalignment when the platform is positioned over the template. The risk increases at greater water depths and is such that the ultimate success of a drilling venture may be vitiated by positional inaccuracies with substantial loss of investment.

The Applicants' studies in this field have indicated that the main cause of failure is likely to be excessive bending stresses in the tieback conductor. This bending stress depends partly on lateral offset between platform and well head, angular offset, and "environmental loadings". By way of example, it may be necessary to maintain the platform vertical to within ±0.5° and lateral misalignment within ±0.65 m (±26″): these figures are given by way of example only.

The invention accordingly provides a conductor guide assembly comprising an outer ring supporting an inner guide, the axes of ring and guide being spaced apart. The ring is mounted on the platform about an aperture and the platform is positioned over the template so that as far as possible the aperture is vertically aligned with the well head. Rotation of the assembly in the aperture moves the axis of the inner guide in relation to the well head axis and enables any spacing between those axes to be minimized.

Conveniently means are provided on the outer ring for location with respect to the aperture in one of a number of possible angular positions. Preferably means are provided on the outer ring for rolling contact with an annular area about the aperture to resist upward force on the assembly.

Turning broadly to the method aspect, the invention provides a method of aligning with a sub-sea well head, a conductor guide mounted in a platform above the well head, the conductor guide being the inner guide of an assembly comprising an outer ring supported in an aperture in the platform and said inner guide supported eccentrically thereon, the method comprising the steps of:

(a) lowering through the guide an adjusting tool having a projection to extend substantially to the well head;

(b) by means of the adjusting tool, rotating the conductor guide assembly in its aperture to bring the axis of the inner guide as near as possible into alignment with the well head; and (c) locking the conductor guide assembly in angular position within the aperture and removing the adjusting tool.

Preferably the tool is lowered, manipulated and subsequently removed by drill string. The adjusting tool can be rotated first on the axis of the inner guide to engage means to lock the tool to the guide, and then on the axis of the outer ring to rotate the tool and assembly as one.

In a preferred system, the tool has a body to locate in the inner guide and to lock releasably thereto for rotation of the assembly, and the drill string is connected to a block mounted on the body and rotatable with respect thereto between limits and lockable thereto. In this preferred system, the method of the invention further comprises the steps of rotating the drill string to move the block with respect to the body to a limit position where the string axis coincides with that of the inner guide, further rotating the drill string thereby to lock the body to the inner guide, rotating the drill string back to another limit position where the string axis coincides with the axis of the outer ring, lifting the string to lock the block to the body and release the assembly for rotation, and thereafter rotating the tool and assembly as one.

As above indicated the invention also provides a tool for use in the system described. In a preferred form the invention provides a tool for adjusting a conductor guide assembly comprising an outer ring supporting an inner guide, the axes of ring and guide being spaced apart, comprising:

(a) a body adapted to enter and locate in the inner guide of the assembly, the body having a generally vertical first axis coincident with that of the inner guide on location therein;

(b) means for establishing coincidence of the first axis with that of a well head;

(c) means for connecting a drill pipe to the body and aligning the pipe, when the body is located in the inner guide, selectively with the axis of the inner guide and the axis of the outer ring;

(d) means to land the body on the assembly and to lock the body thereto for movement together, whereby on landing the body in the inner guide rotation thereof by rotation of the drill string on the inner guide axis locks the body to the assembly whereupon the drill string may be rotated on the axis of the outer ring to bring the axis of the inner guide as near coincident with the well head as possible.

The main object of the invention is to provide a conductor guide system which allows of some wider tolerance in positioning the platform over the template.

Another object is to provide an improved conductor guide assembly for a sub-sea well head which is easily and quickly aligned with the sub-seal well head.

A further object is to provide an improved method of aligning a conductor guide with a sub-sea well head which can be readily operated from the surface and ensures proper alignment.

Still another object is to provide an improved tool for adjusting the sub-sea conductor guide assembly into aligned position from the surface and to lock the assembly in aligned position.

BRIEF DESCRIPTION OF THE DRAWINGS

The invention will be further described with reference to the accompanying diagrammatic drawings, in which one embodiment of the invention is described by way of example. In the drawings.

DESCRIPTION OF PREFERRED EMBODIMENT

Figure 1:
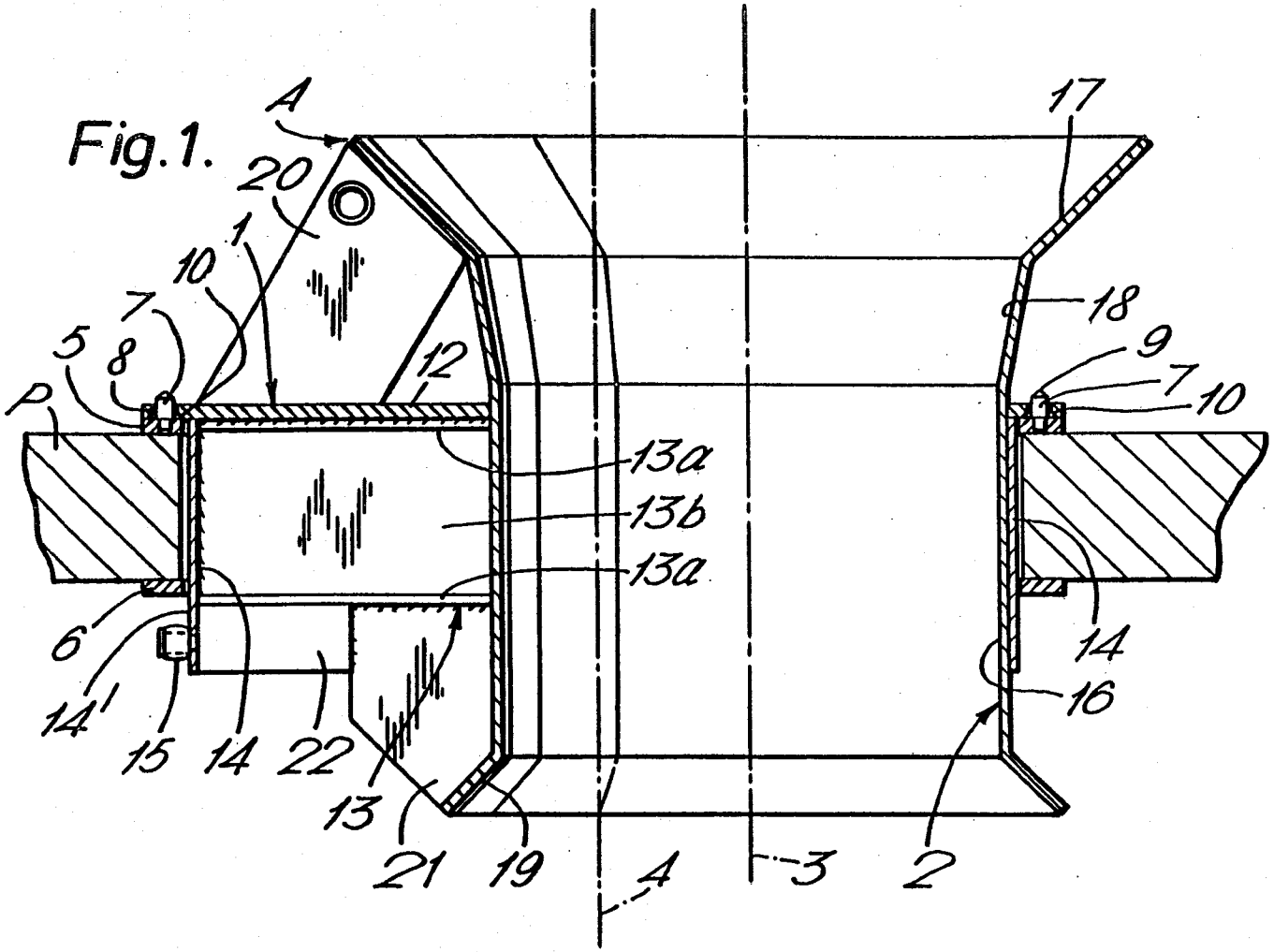
FIG. 1 is a sectional view of an adjustable conductor guide installed on a platform.
Figure 2:
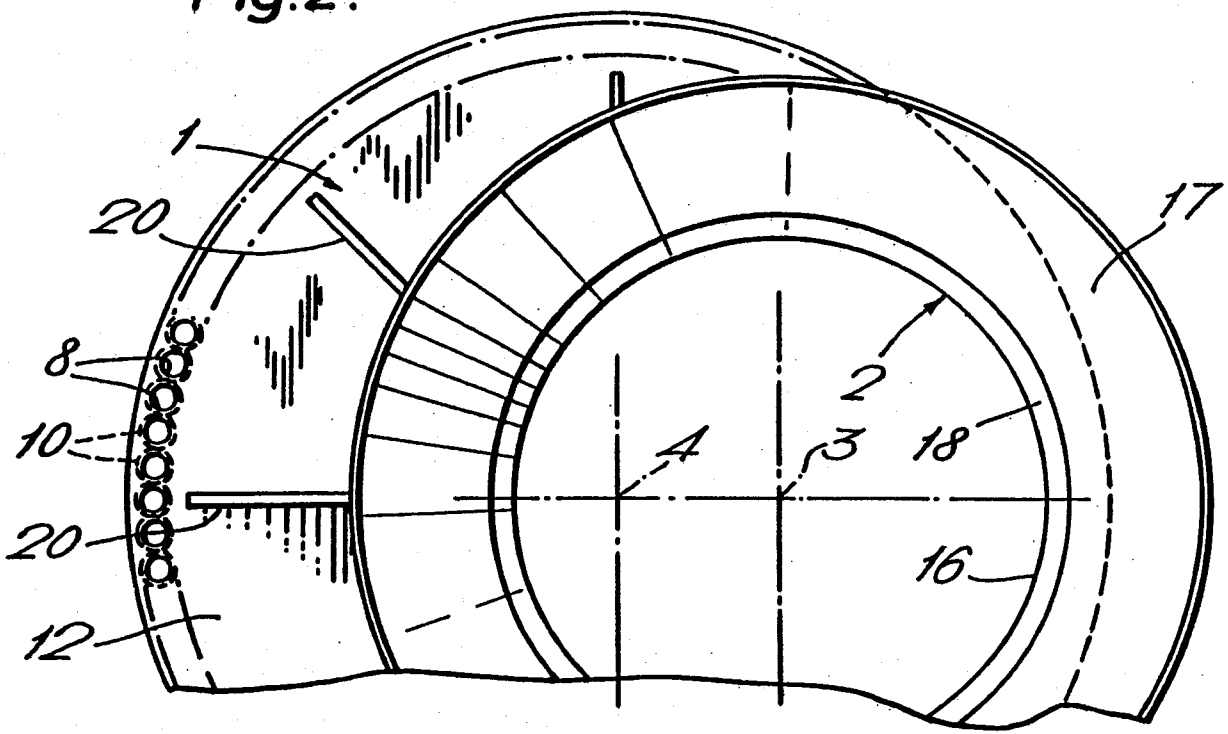
FIG. 2 is a plan view of the FIG. 1 guide, shown partly broken away.

Referring now to FIGS. 1 and 2 of the drawings, an adjustable conductor guide assembly A comprises an outer ring or base designated generally 1 supporting an inner guide designated generally 2, the axes of the ring and guide, respectively 3, 4, being laterally offset. The inner ring 2 is of 50" (1.27 m) interior diameter. The outer ring 1 is supported on a platform shown diagrammatically only at P about an 84" (2.13 m) diameter aperture. Steel rings 5, 6 are fixed to the platform P about the aperture and the upper ring 5 carries four torque pins 7 at 90° angular spacing. The periphery of the outer ring 1 is apertured as shown at 8 to receive the torque pins. It will be appreciated that by lifting the assembly A off the torque pins, turning it and lowering it again, the angular position of the assembly can be varied. Torque pins 7 are bevelled as shown at 9 and the apertures 8 have conical counter-bores 10 so that in whatever positon the ring is lowered, it will engage on the pins. The outer ring 1 is fabricated from a stout upper plate 12 in which the apertures 8 are formed, and a cylindrical side wall 14 engaging with only slight clearance within the aperture in the platform P. I beams 13 having upper and lower flanges 13*a* and a web 13*b* are arranged generally radially at intervals and welded to the plate 12, wall 14 and inner ring 2 to rigidify the structure. Side wall 14 depends below the aperture to form a skirt 14' and the skirt carries at intervals around its periphery roller blocks 15 to engage the lower ring 6 of the platform when the assembly A is lifted for rotation as will be described.

The inner guide 2 comprises a cylindrical wall 16 secured in an aperture in the plate 12 and tangential to the side wall 14. The guide 2 has an upper entry consisting of frustoconical portions 17, 18, the first of wide angle and the second of lesser angle. At the bottom of the inner guide 2 is a conical skirt 19. The construction is rigidified with bracing plates 20, 21, 22 as shown.

Figure 3:
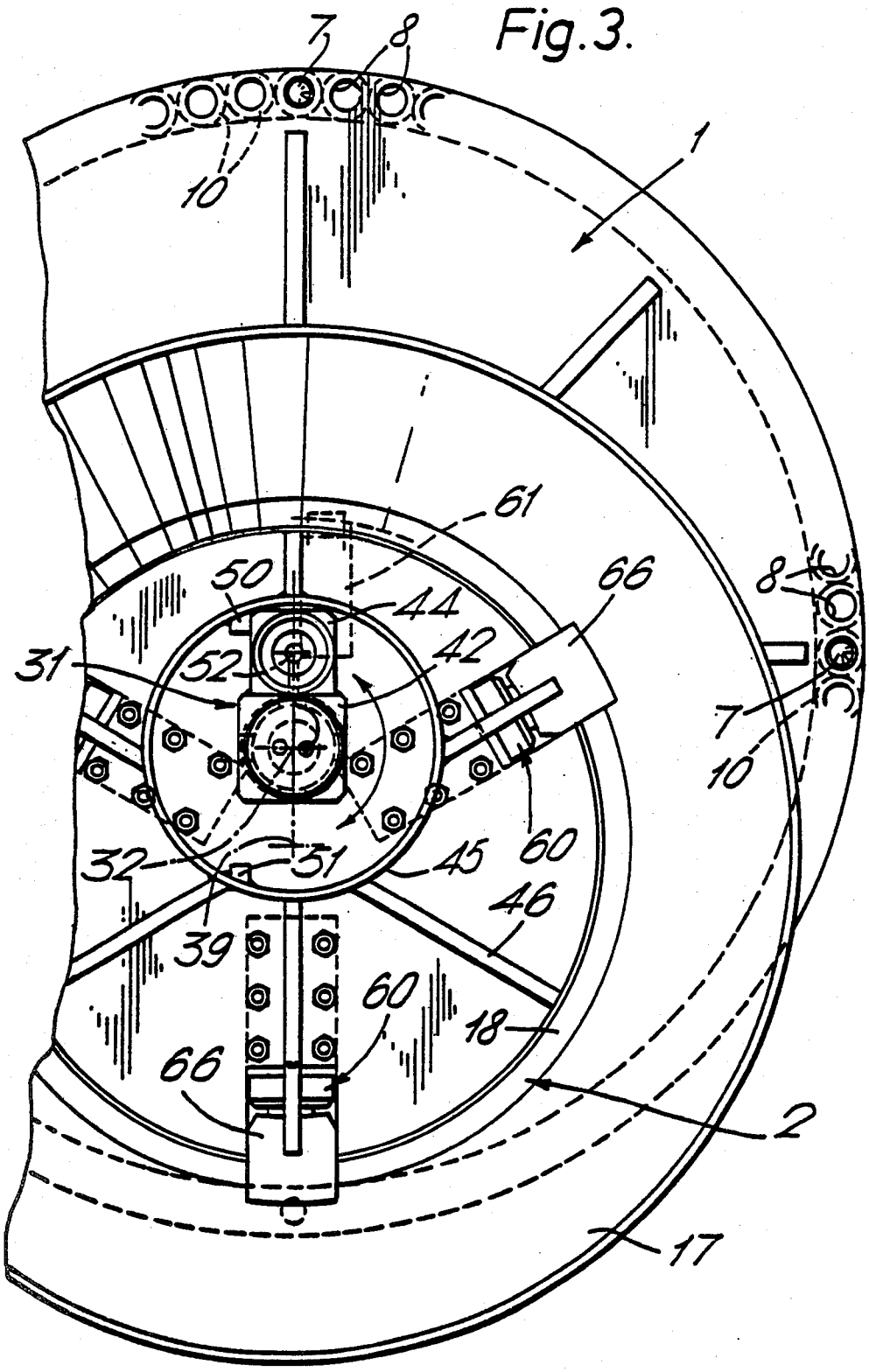
FIG. 3 is a plan view of an adjustable conductor guide in combination with an adjusting tool according to the invention.
Figure 4:
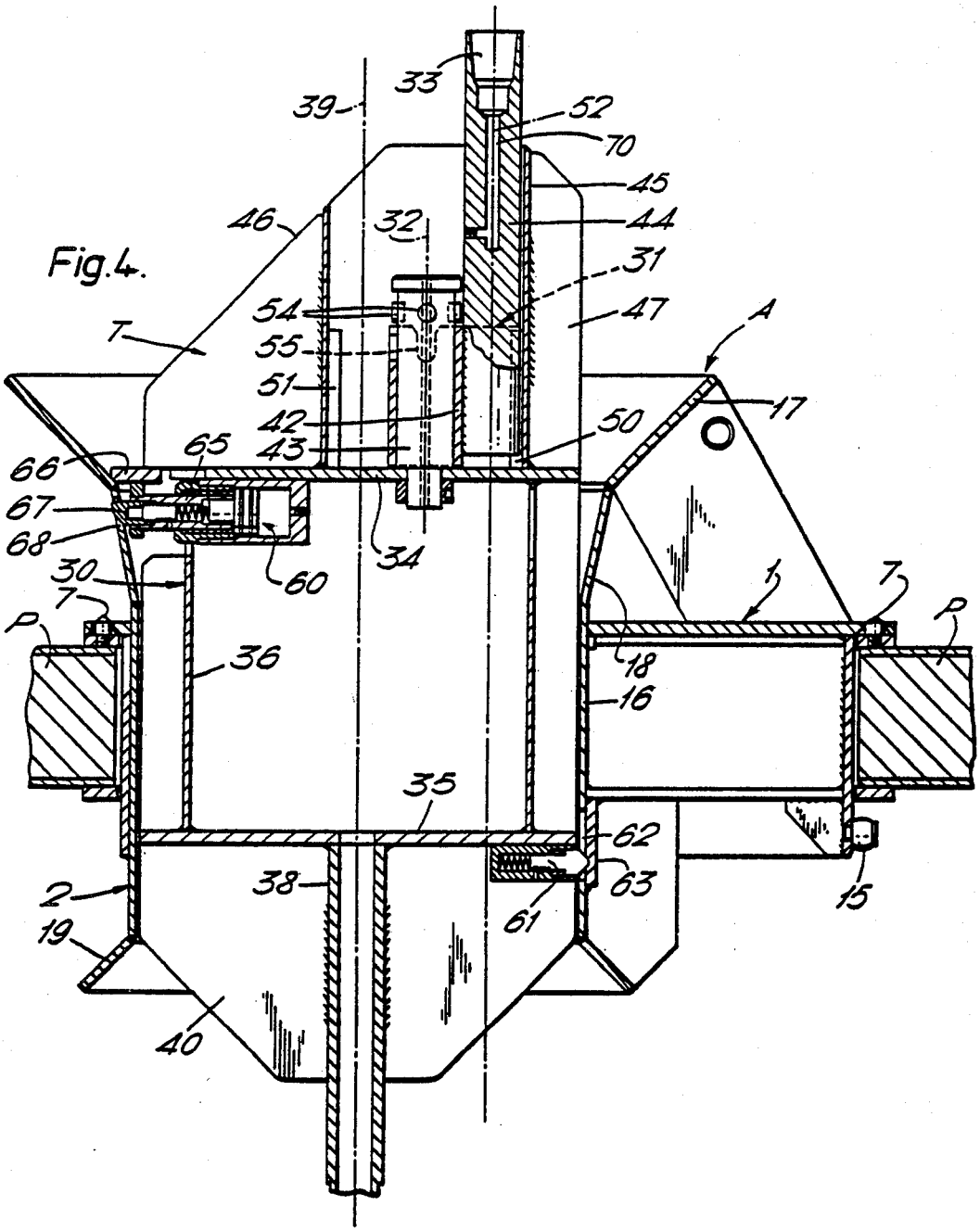
FIG. 4 is a vertical section of the guide and tool, showing also part of the supporting platform.

An adjusting tool for the conductor guide assembly A is shown in FIGS. 3 and 4 and designated generally T. The tool comprises a body designated generally 30 and a block designated generally 31 pivotally connected to the body 30 about a vertical axis 52. The block 31 provides a conventional connection 33 to receive a drill pipe (not shown).

The body 30 of the tool T is designed to enter and locate in the inner guide 2 of the adjustable conductor assembly A. It comprises top and bottom plate 34, 35 adapted to engage with clearance within the cylindrical wall 16 of the assembly A and interconnected by a cylindrical wall 36 set back from the plate edges. A vertical stinger 38 is welded to the bottom plate 35 and extends on the axis 39 of the body, which is also the axis of the inner guide 2 when the body is located within the guide as shown. Bracing plates 40 assist in supporting the stinger 38, which may be composed of drill pipe.

The block 31 comprises a cylindrical housing 42 rotatable on a spigot 43 carried on the upper plate 34 of the tool body. The block further comprises a member 44 welded to the housing 42 and providing the drill pipe connector 33 previously mentioned. A tubular wall 45 surrounds and protects the block 31, being welded to the top plate 34 of the tool body. Bracing plates 46, 47 reinforce the structure. Lugs 50, 51 welded to the top plate 34 provide stops to limit rotation of the block 31 about the axis 32.

The block 31 is shown in the limit position defined by stop 50, and in this position the axis 52 of the drill pipe connector 33 coincides with the axis 4 of the base or outer ring 1 of the adjustable conductor assembly A. The stop 51 defines a limit position for the block 31 where the axis 52 of the drill pipe connector 33 coincides with the axis 3 of the inner guide 2 of assembly A. Drill string connected to the connector 33 can thus swing about the rotational axis 32 of the block between a position where it is aligned with the outer ring axis 4 and a position where it is aligned with the inner guide axis 3. As illustrated, the rotational axis 32 of the block 31 is midway between these axes 3, 4.

The block 31 is movable along the spigot 43 as well as around it. Pins 54 on the spigot 43 are received in slots 55 in the housing 42 when the block 31 is lifted in the position illustrated. The block 31 cannot be lifted in any other position.

The top plate 34 carries on its underside, extending through the side wall 36, three hydraulically operated landing and locating devices designated generally 60. The bottom plate 35 of the tool body carries a spring-loaded torque dog or plunger 61 which is bevelled at top and bottom to engage in a slot 62 formed in the wall 16 of the inner guide. A plate 63 closes the slot and limits outward movement of the plunger.

Devices 60 each provide an outer spring-loaded piston 65 carrying a land-off stop in the form of a plate 66 which, when extended, is adapted to contact the outer entry cone 17 of the inner guide 2. A spring-loaded locating plunger 67 extends coaxially through the outer piston 65 and is adapted to be received in apertures 68 in the inner entry cone 18. There are three of these apertures 68, one for the locating plunger of each of the three devices.

The device 60 is connected by conduits (not shown) to a central duct 70 in the drill pipe connector member 44. The application of pressure within the drill pipe actuates the pistons to the position illustrated where the stops 66 project beyond the tool profile so as to enable it to land within the inner guide 2. The locating plungers 67 then are spring-urged against the inner entry cone 18 until the tool is rotated to align them with the apertures 68. In the absence of hydraulic pressure, stops 66 and plungers 67 are held inactive within the tool profile.

As the torque dog or plunger 61 is positioned to enter its slot 62, so the locating plungers 67 enter their apertures 68. The bevelling on the plunger 61 permits it to cam out of its slot as the tool is lifted out of the inner guide 2; the plunger is not bevelled on its sides, and so can transmit torque to the inner guide.

The operation of the system will now be described with particular reference to FIGS. 5*a* to 5*d*. As here illustrated, the platform provides horizontal members of which two, P1, P2, are shown, each with an adjustable guide assembly A1, A2 respectively, as illustrated in FIGS. 1 and 2, assembled in apertures which are so far as possible located over the well head W protruding through the template T'. It will be seen that, as illustrated, the apertures are out of alignment.

Figures 5A, 5B, 5C, 5D:
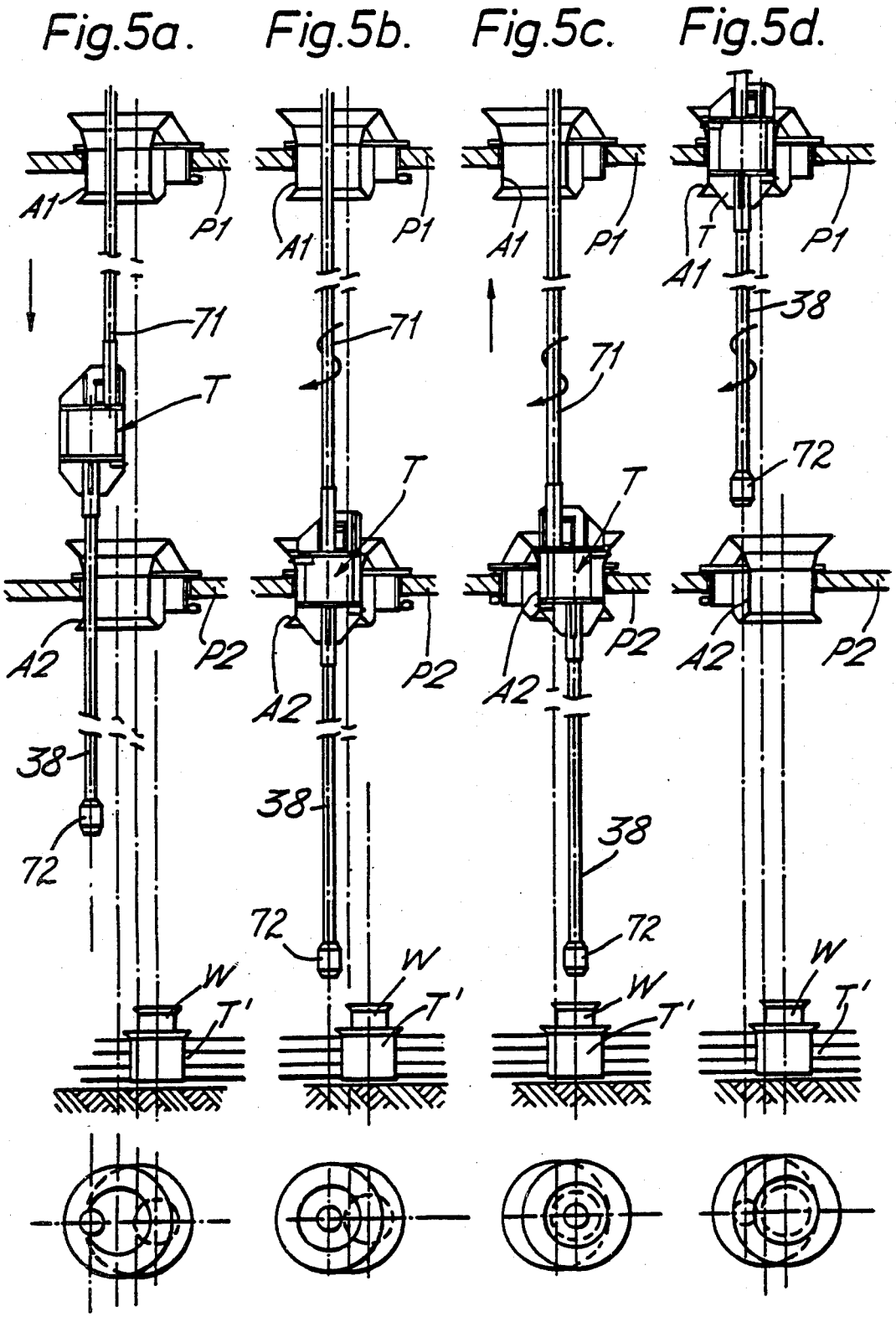
FIGS. 5*a, b, c, d* are diagrammatic side views and plans illustrating various steps in the method according to the invention.

A T.V. "eye" 72 is mounted at the bottom of the stinger 38. The tool T is mounted at the bottom of a drill string 71. The tool is lowered through the upper guide assembly A1 and landed on the lower guide assembly A2 (FIG. 5*b*). For this, hydraulic pressure is applied to the pipe to energize the landing stops 66 and the tool comes to rest in the lower guide assembly A2 as shown generally in FIG. 4. It is arranged that when this happens, the T.V. "eye" is no more than a few feet from the well head W.

The drill pipe 71 is now rotated to the right which brings the block 31 to the stop 51, where the axis of the drill string coincides with that of the tool body 30 and inner ring 2. Further rotation of the drill string 71 rotates the tool body 30 until the plungers 61, 67 locate in their respective openings. Thereafter tool body 30 and assembly A2 move as one.

With the plungers 61, 67 engaged, a light left-hand torque is now applied to the drill string 71 to swing the block 31 around until the drill string axis aligns with that of the outer ring 1. This position is located by the stop 50 on the top plate 34 of the tool.

Lift is now applied to the drill string 71, to lift the block 31 with respect to the tool body 30, thus bringing the pins 54 on the spigot 43 into the slots 55 in the housing 42. The block 31 and tool body 30 are now locked for movement together, and with the assembly A.

Continued lifting of the block 31 lifts the entire tool body 30, and with it the entire assembly A, so that the apertured top plate or outer ring 1 lifts off the pins 7 and the roller blocks 15 engage the lower ring 6 on the platform. Right-hand torque is now applied to the drill string to swing the tool and assembly around the axis 4 of the outer ring until the T.V. "eye" shows the nearest possible correspondence with the well head axis. This condition is illustrated in FIG. 5*c*. The drill string is now lowered to engage apertures 8 in the outer ring 1 over the pins 9 so that the assembly is now permanently located with the conductor guide 2 in the appropriate position. Hydraulic pressure on the devices 60 is now released and the tool withdrawn by the drill string 71 from the conductor guide assembly A2. Release of the pressure allows the springs to withdraw the landing stops 66 and plungers 67. The plunger 54 withdraws from the slot 62 by camming at the end of the slot as explained.

The process is repeated with the next upper guide assembly A1 in platform member P1, so as to align the axis of the inner guide as near as possible with the axis of the lower guide A2.

It will be appreciated that exact alignment of the adjustable guide with the well head axis may not be possible, for example if the platform aperture is perfectly aligned to start with. However, in that case the misalignment will be within acceptable limits. Normally it will be possible to achieve quite close alignment and the system of the invention allows, therefore, much wider tolerance in the position of the platform with respect to the well head.

What is claimed is:

1. A method of aligning with a sub-sea well head a conductor guide mounted in a platform above the well head, the conductor guide being the inner guide of an assembly comprising an outer ring supported in an aperture in the platform and said inner guide supported eccentrically thereon and releasably restrained against rotation with respect to said outer ring, the method comprising the steps of:

(a) lowering through the guide an adjusting tool having a projection to extend substantially to the well head;

(b) by means of the adjusting tool, releasing and rotating the conductor guide assembly in its aperture to bring the axis of the inner guide as near as possible into alignment with the well head; and (c) locking the conductor guide assembly in angular position within the aperture and removing the adjusting tool.

2. A method of aligning conductor guides with a sub-sea well head comprising:

(a) installing a platform over the well head, the platform having an aperture approximately aligned with the well head;

(b) mounting on to the aperture a conductor guide assembly comprising an outer ring supporting an eccentric inner guide with the guide releasably restrained against rotating with respect to the outer ring;

(c) lowering through the guide an adjusting tool having a projection to extend substantially to the well head;

(d) releasing and rotating the conductor guide assembly in its aperture with said adjusting tool to bring the axis of the inner guide as near as possible into alignment with the well head; and (e) locking the conductor guide assembly in angular position within the aperture and removing the adjusting tool.

3. A method as claimed in claim 1 or claim 2, wherein the tool is lowered, manipulated and subsequently removed by drill string.

4. A method as claimed in claim 3, wherein the adjusting tool is manipulated by the drill string to rotate first on the axis of the inner guide to engage means to lock the tool to the guide, and then on the axis of the outer ring to rotate tool and assembly as one.

5. A method as claimed in claim 3, the tool having a body which is located in the inner guide to lock releasably thereto for rotation of the assembly and the drill string being connected to a block mounted on the body and rotatable with respect thereto between limits and lockable thereto, the method further comprising the steps of rotating the drill string to move the block with respect to the body to a limit position where the string axis coincides with that of the inner guide, further rotating the drill string thereby to lock the body to the inner guide, rotating the drill string back to another limit position where the string axis coincides with the axis of the outer ring, lifting the string to lock the block to the body and release the assembly for rotation, and thereafter rotating the tool and assembly as one.

6. A conductor guide assembly for use in an aperture in a drilling platform comprising an outer ring, an inner cylindrical guide mounted on said outer ring with the axis of said inner cylindrical guide being laterally offset from the axis of said outer ring, means for releasably retaining said outer ring against relative rotation in the platform aperture in which it is mounted, and means on said inner ring for engagement by a device to disengage said retaining means and to rotate said inner ring in said outer ring to change the relative positions of their axes.

7. An assembly according to claim 6 wherein said retaining means includes at least one pin on said outer ring extending upward, and a flange on said inner guide having an outer diameter substantially the same as the diameter of the outer ring, said flange having a plurality of apertures for receiving said pin to retain said inner ring against rotation when said flange is over said pin.

8. As assembly according to claim 6 including means on the outer ring for rolling contact with an annular area about the aperture to resist upward force on the assembly.

9. A tool for adjusting a conductor guide assembly comprising an outer ring supporting an inner guide, the axes of ring and guide being spaced apart, comprising;

(a) a body adapted to enter and locate in the inner guide of the assembly, the body having a generally vertical first axis coincident with that of the inner guide on location therein;

(b) means for establishing coincidence of the first axis with that of a well head;

(c) means for connecting a drill pipe to the body and aligning the pipe, when the body is located in the inner guide, selectively with the axis of the inner guide and the axis of the outer ring;

(d) means to land the body on the assembly and to lock the body thereto for movement together, whereby on landing the body in the inner guide rotation thereof by rotation of the drill string on the inner guide axis locks the body to the assembly whereupon the drill string may be rotated on the axis of the outer ring to bring the axis of the inner guide as near coincident with the well head as possible.

10. A tool for adjusting a conductor guide assembly comprising an outer ring supporting an inner guide, the axes of ring and guide being spaced apart, comprising:

(a) a body adapted to enter and locate in the inner guide of the assembly, the body having a generally vertical first axis coincident with that of the inner guide on location therein;

(b) a projection downward from the body for establishing coincidence of the first axis with that of a well head;

(c) a connector block mounted on the body for angular movement with respect thereto about a second vertical axis;

(d) a connection on the block for drill pipe on a third vertical axis spaced from the second;

(e) means to land the body on the assembly and to lock the body thereto for movement together;

(f) means limiting relative movement of the block and the body for selective alignment of the third axis with the axis of the outer ring and with the first axis by rotation of the block around the second axis; and (g) means, effective on lifting the block relative to the body when body and block are in said first position, to connect body and block for rotation together, whereby on landing the body in the inner guide, rotation of the drill string aligns it with the inner guide axis and rotates the tool body therein to lock it to the assembly, counter rotation of the drill string aligns it with the axis of the outer ring, and lifting and subsequent rotation of the drill string rotates the assembly about the axis of the outer ring.

11. A tool as claimed in claim 10, wherein the means to land the body on the assembly includes hydraulically actuated plunger means on the body and a hydraulic connection between the drill pipe connection and the plunger means.

* * * * *